US010390673B2

(12) United States Patent
Liang et al.

(10) Patent No.: US 10,390,673 B2
(45) Date of Patent: Aug. 27, 2019

(54) CLEANING ROBOT

(71) Applicant: SHENZHEN TOPBAND CO., LTD., Shenzhen, Guangdong (CN)

(72) Inventors: Feng Liang, Guangdong (CN); Shilin Liang, Guangdong (CN)

(73) Assignee: SHENZHEN TOPBAND CO., LTD., Shenzhen (CN)

( * ) Notice: Subject to any disclaimer, the term of this patent is extended or adjusted under 35 U.S.C. 154(b) by 211 days.

(21) Appl. No.: 15/540,561

(22) PCT Filed: Aug. 21, 2015

(86) PCT No.: PCT/CN2015/087831

§ 371 (c)(1),
(2) Date: Jun. 28, 2017

(87) PCT Pub. No.: WO2016/107194

PCT Pub. Date: Jul. 7, 2016

(65) Prior Publication Data

US 2017/0367553 A1 Dec. 28, 2017

(30) Foreign Application Priority Data

Dec. 29, 2014 (CN) ..... 2014 1 0841328

(51) Int. Cl.

| | |
|---|---|
| ***A47L 11/29*** | (2006.01) |
| ***A47L 11/40*** | (2006.01) |
| ***A47L 11/24*** | (2006.01) |

(52) U.S. Cl.

CPC ..... *A47L 11/29* (2013.01); *A47L 11/24* (2013.01); *A47L 11/4011* (2013.01); (Continued)

(58) Field of Classification Search

CPC ..... A47L 11/29; A47L 11/24; A47L 11/4011; A47L 11/4016; A47L 11/4019; (Continued)

(56) References Cited

U.S. PATENT DOCUMENTS 5,327,609 A * 7/1994 Bierma ..... A47L 11/00 15/228
7,013,528 B2 * 3/2006 Parker ..... A47L 5/28 15/364

(Continued)

FOREIGN PATENT DOCUMENTS

| | | | |
|---|---|---|---|
| CN | 201239102 | Y | 5/2009 |
| CN | 202044212 | U | 11/2011 |
| CN | 204445700 | U | 7/2015 |

OTHER PUBLICATIONS

International Search Report of PCT Patent Application No. PCT/CN2015/087831 dated Dec. 11, 2015.

*Primary Examiner* — Dung Van Nguyen

(57) ABSTRACT

The present disclosure provides cleaning robot, including a cleaning agent mopping device (1), a cleaning agent absorbing device (2), a water wiping (3) and washing device (4), and a water absorbing device arranged in turn along a moving direction of the cleaning robot. Each time when the cleaning robot of the present disclosure works to clean the to-be-cleaned surface, the cleaning robot can perform the four steps including cleaning agent mopping, cleaning agent absorbing, water wiping and washing, and water absorbing, thus, both hydrolysable and non-hydrolysable stains can be effectively cleaned by the cleaning robot. Thus, the cleaning robot is very practical, easy to operate, and simple to use.

10 Claims, 1 Drawing Sheet

(52) U.S. Cl.
CPC ..... *A47L 11/4016* (2013.01); *A47L 11/4019* (2013.01); *A47L 11/4044* (2013.01); *A47L 11/4047* (2013.01); *A47L 11/4066* (2013.01); *A47L 11/4072* (2013.01); *A47L 11/4083* (2013.01); *A47L 11/4088* (2013.01); *A47L 2201/00* (2013.01); *A47L 2201/04* (2013.01)

(58) Field of Classification Search
CPC .. A47L 11/4044; A47L 11/4047; A47L 11/11; A47L 11/4066; A47L 11/4083; A47L 11/4088; A47L 2201/00; A47L 2201/04
See application file for complete search history.

(56) References Cited

U.S. PATENT DOCUMENTS

| | | | | |
|---|---|---|---|---|
| 7,784,147 | B2 * | 8/2010 | Burkholder | A47L 11/03 15/320 |
| 8,650,692 | B2 * | 2/2014 | Liu | A47L 11/4013 15/1.51 |
| 2002/0011813 | A1 * | 1/2002 | Koselka | A47L 11/24 318/445 |

* cited by examiner

CLEANING ROBOT

BACKGROUND

1. Technical Field

The present disclosure generally relates to smart homes, and particularly, to a cleaning robot.

2. Description of Related Art

Cleaning of home and public activity area has always been a time-consuming and dirty work. The popularization of ground cleaning tools such as vacuum cleaners and washing and drying machines reduces the burden of ground cleaning on people. However, handy operations are still required when these tools are used and cleaning of these tools needs to be finished by hand after usage. Thus, the traditional home ground cleaning tools cannot satisfy people's requirements nowadays. With the development of social technology, many automatic or semiautomatic sweepers or cleaning robots appear.

At present, the work of a cleaning robot on the market typically includes the following three steps: spraying water, washing and brushing, and reclaiming wastewater. Most of hydrolysable stains can be cleaned through the work of the cleaning tool, but for non-hydrolysable stains, the cleaning tool cannot effectively work.

SUMMARY

In order to solve the above problem, the present disclosure provides a new type of cleaning robot.

According to one aspect of the present disclosure, a cleaning robot is provided. The cleaning robot includes a cleaning agent mopping device, a cleaning agent absorbing device, a water wiping and washing device, and a water absorbing device arranged in turn along a moving direction of the cleaning robot; the cleaning agent mopping device includes a first crawler device contacting a to-be-cleaned surface and a cleaning agent container, and the first crawler device applies cleaning agent from the cleaning agent container to the to-be-cleaned surface and reclaims wastewater; the cleaning agent absorbing device includes a second crawler device for absorbing remained cleaning agent on the to-be-cleaned surface and reclaiming wastewater; the water wiping and washing device includes a third crawler device for contacting the to-be-cleaned surface and a water container, and the third crawler applies water from the water container to the to-be-cleaned surface and reclaims wastewater; and the water absorbing device includes a fourth crawler device for contacting the to-be-cleaned surface, and the fourth crawler device absorbs remained water on the to-be-cleaned surface and reclaims wastewater.

Optionally, the first crawler device includes three first supporting shafts, a first crawler, a couple of first clamping shafts, and a first driving motor; the first crawler surrounds the first supporting shafts, the first clamping shafts tightly clamp the first crawler, and the first driving motor is transmissively connected to the first clamping shafts; and, when the first driving motor is working, the first driving motor drives the first clamping shafts to rotate in opposite directions, and a friction between the first clamping shafts and the first crawler drives the first crawler to rotate and squeezes wastewater out of a surface of the first crawler.

Optionally, the first crawler surrounds the first supporting shafts to form an inverted triangular structure; and one of the supporting shafts located at a bottom of the inverted triangular structure presses the first crawler to the to-be-cleaned surface, enabling the first crawler to contact and rub the to-be-cleaned surface.

Optionally, the second crawler device includes three second supporting shafts, a second crawler, a couple of second clamping shafts, and a second driving motor; the second crawler surrounds the second supporting shafts, the second clamping shafts tightly clamp the second crawler, and the second driving motor is transmissively connected to the second clamping shafts; and, when the second driving motor is working, the second driving motor drives the second clamping shafts to rotate in opposite directions, and a friction between the second clamping shafts and the second crawler drives the second crawler to rotate and squeezes wastewater out of a surface of the second crawler.

Optionally, the second crawler surrounds the second supporting shafts to form an inverted triangular structure; and one of the supporting shafts located at a bottom of the inverted triangular structure presses the second crawler to the to-be-cleaned surface, enabling the second crawler to contact and rub the to-be-cleaned surface.

Optionally, the third crawler device includes three third supporting shafts, a third crawler, a couple of third clamping shafts, and a third driving motor; the third crawler surrounds the third supporting shafts, the third clamping shafts tightly clamp the third crawler, and the third driving motor is transmissively connected to the third clamping shafts; and, when the third driving motor is working, the third driving motor drives the third clamping shafts to rotate in opposite directions, and a friction between the third clamping shafts and the third crawler drives the third crawler to rotate and squeezes wastewater out of a surface of the third crawler.

Optionally, the third crawler surrounds the third supporting shafts to form an inverted triangular structure; and one of the supporting shafts located at a bottom of the inverted triangular structure presses the third crawler to the to-be-cleaned surface, enabling the third crawler to contact and rub the to-be-cleaned surface.

Optionally, the fourth crawler device includes three fourth supporting shafts, a fourth crawler, a couple of fourth clamping shafts, and a fourth driving motor; the fourth crawler surrounds the fourth supporting shafts, the fourth clamping shafts tightly clamp the fourth crawler, and the fourth driving motor is transmissively connected to the fourth clamping shafts; and, when the fourth driving motor is working, the fourth driving motor drives the fourth clamping shafts to rotate in opposite directions, and a friction between the fourth clamping shafts and the fourth crawler drives the fourth crawler to rotate and squeezes wastewater out of the fourth crawler.

Optionally, the fourth crawler surrounds the fourth supporting shafts to form an inverted triangular structure; and one of the supporting shafts located at a bottom of the inverted triangular structure presses the fourth crawler to the to-be-cleaned surface, enabling the fourth crawler to contact and rub the to-be-cleaned surface.

Optionally, the cleaning robot further includes a housing, a moving wheel group, a wastewater container, and a power supply; the cleaning agent mopping device, the cleaning agent absorbing device, the water wiping and washing device, and the water absorbing device are arranged at a middle position on a bottom portion of the housing; the moving wheel group includes a driving wheel arranged on a foremost end of the bottom portion of the housing and two driven wheels arranged at two sides on the bottom portion of the house, and the driven wheels are located behind the driving wheel along the moving direction of the cleaning robot; the wastewater container is arranged on a rear portion of the housing, and the cleaning agent mopping device, the cleaning agent absorbing device, the water wiping and washing device, and the water absorbing device respectively include a guiding slot or a guiding pipe to guide wastewater to the wastewater container; and the power supply is arranged on a top portion of the housing for supplying power to the cleaning agent mopping device, the cleaning agent absorbing device, the water absorbing device, and the water absorbing device.

Each time when the cleaning robot of the present disclosure works to clean the to-be-cleaned surface, the cleaning robot can perform the four steps including cleaning agent mopping, cleaning agent absorbing, water wiping and washing, and water absorbing, thus, both hydrolysable and non-hydrolysable stains can be effectively cleaned by the cleaning robot. Thus, the cleaning robot is very practical, easy to operate, and simple to use.

BRIEF DESCRIPTION OF THE DRAWINGS

The present disclosure will be described in more detail with reference to the accompany drawings and the embodiments, wherein in the drawings.

Figure 1:
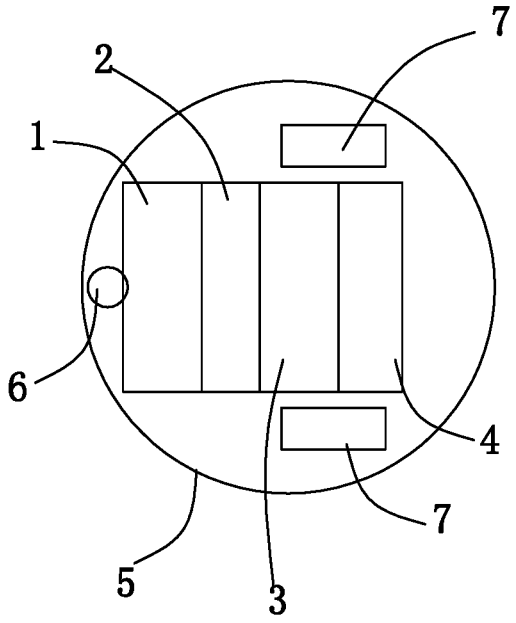
FIG. 1 is a bottom view of a cleaning robot in accordance with an embodiment of the present disclosure.

wherein: reference number 1 represents a cleaning agent mopping device, reference number 11 represents a first crawler device, reference number 111 represents a first supporting shaft, reference number 112 represents a first crawler, reference number 113 represents a first clamping shaft, reference number 12 represents a cleaning agent container, reference number 2 represents a cleaning agent absorbing device, reference number 21 represents a second crawler device, reference number 211 represents a second supporting shaft, reference number 212 represents a second crawler, reference number 213 represents a second clamping shaft, reference number 12 represents a cleaning agent container, reference number 3 represents a water wiping and washing device, reference number 31 represents a third crawler device, reference number 311 represents a third supporting shaft, reference number 312 represents a third crawler, reference number 313 represents a third clamping shaft, reference number 32 represents a water container, reference number 4 represents a water absorbing device, reference number 41 represents a fourth crawler device, reference number 411 represents a fourth supporting shaft, reference number 412 represents a fourth crawler, reference number 413 represents a fourth clamping shaft, reference number 5 represents a housing, reference number 6 represents a driving wheel, reference number 7 represents a driven wheel, reference number 8 represents a wastewater container, reference number 9 represents a power supply, and reference number 10 represents a controller.

DETAILED DESCRIPTION

For clearly understanding technical features, purpose, and effect of the present disclosure, embodiments are given in detail hereinafter with reference to the accompanying drawings.

Figure 2:
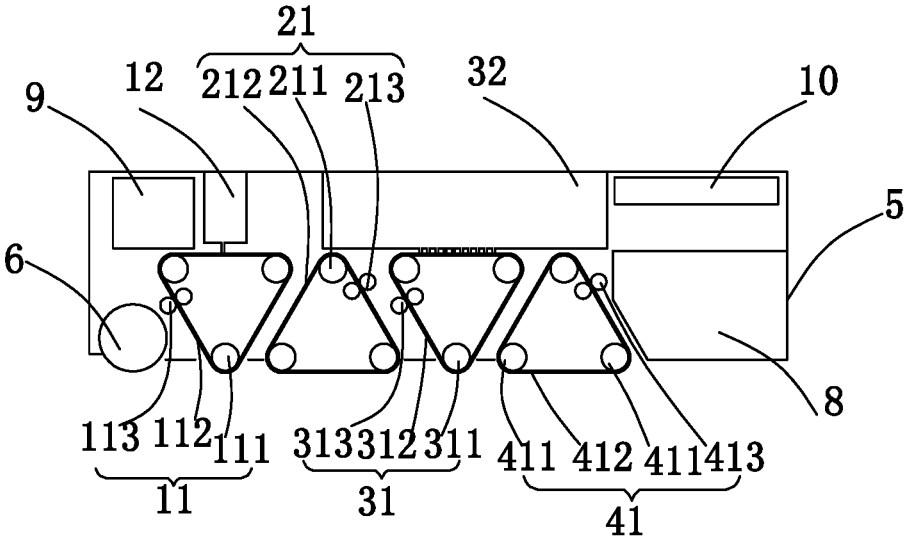
FIG. 2 is a side view of the cleaning robot of FIG. 1.

FIGS. 1 and 2 show a cleaning robot in accordance with an embodiment of the present disclosure. The cleaning robot mainly relates to home floor caring appliances. The cleaning robot can finish floor mopping of daily housekeeping well, and the intelligence and automation of the cleaning robot are improved in a certain degree such that the cleaning robot can meet requirements in the era of intelligent internet better.

FIG. 1 is a bottom view of the cleaning robot and FIG. 2 is a side view of the cleaning robot.

Referring to FIG. 1, the cleaning robot includes a cleaning agent mopping device 1, a cleaning agent absorbing device 2, a water wiping and washing device 3, and a water absorbing device 4. The cleaning agent mopping device 1, the cleaning agent absorbing device 2, the water wiping and washing device 3, and the water absorbing device 4 are arranged in turn along a moving direction of the cleaning robot, such that the cleaning robot can finish the four steps of floor cleaning consequently including cleaning agent mopping, cleaning agent absorbing, water wiping and washing, and water absorbing.

The cleaning agent mopping device 1 includes a first crawler device 11 and a cleaning agent container 12. The first crawler device 11 contacts a to-be-cleaned surface when the cleaning robot is used to clean the to-be-cleaned surface. The cleaning agent container 12 is arranged above the first crawler device 11, thus, the cleaning agent can flow to the first crawler device 11 directly through an opening defined in a bottom of the cleaning agent container 12 under gravity. Then, the first crawler device 11 applies the cleaning agent to the to-be-cleaned surface and reclaims wastewater. During this process, the first crawler device 11 with the cleaning agent contacts and rubs the to-be-cleaned surface to finish the cleaning agent mopping step. It is noted that the arrangement of the cleaning agent container 12 is not limited to this embodiment; in other embodiment, the cleaning agent container 12 can be arranged in other suitable positions.

The cleaning agent absorbing device 2 includes a second crawler device 21 contacting the to-be-cleaned surface when the cleaning robot is used to clean the to-be-cleaned surface. The second crawler device 21 absorbs remained cleaning agent on the to-be-cleaned surface and reclaims wastewater. During this process, the second crawler device 21 contacts and rubs the to-be-cleaned surface to finish the cleaning agent absorbing step.

The water wiping and washing device 3 includes a third crawler device 31 and a water container 32. The third crawler device 31 contacts the to-be-cleaned surface when the cleaning robot is used to clean the to-be-cleaned surface. The water container 32 is arranged above the third crawler device 31, such that clean water in the water container 32 can flow to the third crawler device 31 directly through an opening defined in a bottom of the water container 32. Then, the third crawler device 31 applies the clean water onto the to-be-cleaned surface and reclaims wastewater. During this process, the third crawler device 31 contacts and rubs the to-be-cleaned surface to finish the water wiping and washing step. It is noted that the arrangement of the water container 32 is not limited to this embodiment; in other embodiment, the water container 32 can be arranged in other suitable positions.

The water absorbing device 4 includes a fourth crawler device 41 contacting the to-be-cleaned surface when the cleaning robot is used to clean the to-be-cleaned surface. The fourth crawler device 41 absorbs remained clean water or remained cleaning agent on the to-be-cleaned surface and reclaims wastewater. During this process, the fourth crawler device 41 contacts and rubs the to-be-cleaned surface to finish the water absorbing step.

As sated above, each time when the cleaning robot works to clean the to-be-cleaned surface, the cleaning robot can perform the four steps including cleaning agent mopping, cleaning agent absorbing, water wiping and washing, and water absorbing, thus, both hydrolysable and non-hydrolysable stains can be effectively cleaned by the cleaning robot. Thus, the cleaning robot is very practical, easy to operate, and simple to use.

In some embodiments, referring to FIG. 2, the first crawler device 11 includes three first supporting shafts 111, a first crawler 112, a couple of first clamping shafts 113, and a driving motor. Generally, a linear speed of the first crawler device 11 is greater than a linear moving speed of the cleaning robot, thereby improving the cleaning effect of the cleaning robot.

The first crawler 112 surrounds the first supporting shafts 111, the first clamping shafts 113 tightly clamp the first crawler 112, and the first driving motor is transmissively connected to the first clamping shafts 113. The first supporting shafts 111 and the first clamping shafts 113 are secured via any suitable means such as a bracket.

In operation, the first driving motor drives the first clamping shafts 113 to rotate in opposite directions. A friction between the first clamping shafts 113 and the first crawler 112 drives the first crawler 112 to rotate and squeezes wastewater out of a surface of the first crawler 112. The first clamping shafts 113 apply a clamping force and a rotating force to the first crawler 112, such that the first crawler 112 is driven to rotate by the friction between the first clamping shafts 113 and the first crawler 112. As the first crawler 112 moves between the first clamping shafts 113, wastewater is squeezed out of the first crawler 112 by the clamping force from the first clamping shafts 113.

The first crawler 112 surrounds the first supporting shafts 111 to form an inverted triangular structure. One of the first supporting shafts 111 located at a bottom of the inverted triangular structure presses the first crawler 112 to the to-be-cleaned surface, enabling the first crawler 112 to contact and rub the to-be-cleaned surface. It is understood that the inverted triangular structures not only improves the stability of the cleaning robot but also forms a moving unit of the cleaning robot which can move across most of obstacles on the to-be-cleaned surface, thus, the cleaning robot is capable of moving in various indoor environments.

In some embodiments, the first crawler 112 can be a single-sided water absorbing crawler, that is, an outer surface of the first crawler 112 corresponding to the to-be-cleaned surface is water absorbent. An inner surface of the first crawler 112 is of high friction.

The second crawler device 21 includes three supporting shafts 211, a second crawler 212, a couple of clamping shafts 213, and a second riving motor. Generally, a linear speed of the second crawler device 211 is greater than a linear moving speed of the cleaning robot, thereby improving effect of the cleaning robot.

The second crawler 212 surrounds the second supporting shafts 111, the second clamping shafts 213 tightly clamp the second crawler 212, and the second driving motor is transmissively connected to the second clamping shafts 213. The second supporting shafts 211 and the second clamping shafts 213 are secured via any suitable means such as a bracket.

In operation, the second driving motor drives the second clamping shafts 213 to rotate in opposite directions. A friction between the second clamping shafts 213 and the second crawler 212 drives the second crawler 212 to rotate and squeeze wastewater out of a surface of the second crawler 212. The second clamping shafts 213 apply a clamping force and a rotating force to the second crawler 212, such that the second crawler 212 is driven to rotate by the friction between the second clamping shafts 213 and the second crawler 212. As the second crawler 212 moves between the second clamping shafts 213, wastewater is squeezed out of the second crawler 212 by the clamping force from the second clamping shafts 213.

The second crawler 212 surrounds the second supporting shafts 211 to form an inverted triangular structure. One of the second supporting shafts 211 located at a bottom of the inverted triangular structure presses the second crawler 212 to the to-be-cleaned surface, enabling the second crawler 212 to contact and rub the to-be-cleaned surface. It is understood that the inverted triangular structures not only improves the stability of the cleaning robot but also forms a moving unit of the cleaning robot which can move across most of obstacles on the to-be-cleaned surface, thus, the cleaning robot is capable of moving in various indoor environments.

In some embodiments, the second crawler 212 can be a single-sided water absorbing crawler, that is, an outer surface of the second crawler 212 corresponding to the to-be-cleaned surface is water absorbent. An inner surface of the second crawler 212 is of high friction.

In some embodiments, referring to FIG. 2, the third crawler device 31 includes three third supporting shafts 311, a third crawler 312, a couple of third clamping shafts 313, and a driving motor. Generally, a linear speed of the third crawler device 31 is greater than a linear moving speed of the cleaning robot, thereby improving the cleaning effect of the cleaning robot.

The third crawler 312 surrounds the third supporting shafts 311, the third clamping shafts 313 tightly clamp the third crawler 312, and the third driving motor is transmissively connected to the third clamping shafts 313. The third supporting shafts 311 and the third clamping shafts 313 are secured via any suitable means such as a bracket.

In operation, the third driving motor drives the third clamping shafts 313 to rotate in opposite directions. A friction between the third clamping shafts 313 and the third crawler 312 drives the third crawler 312 to rotate and squeezes wastewater out of a surface of the third crawler 312. The third clamping shafts 313 apply a clamping force and a rotating force to the third crawler 312, such that the third crawler 312 is driven to rotate by the friction between the third clamping shafts 313 and the third crawler 312. As the third crawler 312 moves between the third clamping shafts 313, wastewater is squeezed out of the third crawler 312 by the clamping force from the third clamping shafts 313.

The third crawler 312 surrounds the third supporting shafts 311 to form an inverted triangular structure. One of the third supporting shafts 311 located at a bottom of the inverted triangular structure presses the third crawler 312 to the to-be-cleaned surface, enabling the third crawler 312 to contact and rub the to-be-cleaned surface. It is understood that the inverted triangular structure not only improves the stability of the cleaning robot but also forms a moving unit of the cleaning robot which can move across most of obstacles on the to-be-cleaned surface, thus, the cleaning robot is capable of moving in various indoor environments.

In some embodiments, the third crawler 312 can be a single-sided water absorbing crawler, that is, an outer surface of the third crawler 312 corresponding to the to-be-cleaned surface is water absorbent. An inner surface of the third crawler 312 is of high friction.

In some embodiments, referring to FIG. 2, the fourth crawler device 41 includes three fourth supporting shafts 411, a fourth crawler 412, a couple of fourth clamping shafts 413, and a driving motor. Generally, a linear speed of the fourth crawler device 41 is greater than a linear moving speed of the cleaning robot, thereby improving the cleaning effect of the cleaning robot.

The fourth crawler 412 surrounds the fourth supporting shafts 411, the fourth clamping shafts 413 tightly clamp the fourth crawler 412, and the fourth driving motor is transmissively connected to the fourth clamping shafts 413. The fourth supporting shafts 411 and the fourth clamping shafts 413 are secured via suitable means such as a bracket.

In operation, the fourth driving motor drives the fourth clamping shafts 413 to rotate in opposite directions. A friction between the fourth clamping shafts 413 and the fourth crawler 412 drives the fourth crawler 412 to rotate and squeezes wastewater out of a surface of the fourth crawler 412. The fourth clamping shafts 413 apply a clamping force and a rotating force to the fourth crawler 412, such that the fourth crawler 412 is driven to rotate by the friction between the fourth clamping shafts 413 and the fourth crawler 412. As the fourth crawler 412 moves between the fourth clamping shafts 413, wastewater is squeezed out of the fourth crawler 412 by the clamping force from the fourth clamping shafts 413.

The fourth crawler 412 surrounds the fourth supporting shafts 411 to form an inverted triangular structure. One of the fourth supporting shafts 411 located at a bottom of the inverted triangular structure presses the fourth crawler 412 to the to-be-cleaned surface, enabling the fourth crawler 412 to contact and rub the to-be-cleaned surface. It is understood that the inverted triangular structures not only improves the stability of the cleaning robot but also forms a moving unit of the cleaning robot which can move across most of obstacles on the to-be-cleaned surface, thus, the cleaning robot is capable of moving in various indoor environments.

In some embodiments, the fourth crawler 412 can be a single-sided water absorbing crawler, that is, an outer surface of the fourth crawler 412 corresponding to the to-be-cleaned surface is water absorbent. An inner surface of the fourth crawler 412 is of high friction.

In some embodiments, referring to FIGS. 1 and 2, the cleaning robot further includes a housing 5, a moving wheel group, a wastewater container 8, and a power supply 9.

The housing 5 houses and protects the above components of the cleaning robot. The cleaning agent mopping device 1, the cleaning agent absorbing device 2, the water wiping and washing device 3, and the water absorbing device 4 are arranged at a middle position on a bottom of the housing 5.

The moving wheel group includes a driving wheel 6 arranged on a foremost end of a bottom portion of the housing 5. That is, the driving wheel 6 is located on the foremost end along the moving direction of the cleaning robot. In an embodiment, the driving wheel 6 can be a universal driving wheel. The moving wheel group further includes two driven wheels 7 arranged at two sides on the bottom portion of the house 5. The driven wheels 7 are located behind the driving wheel 6 along the moving direction of the cleaning robot. In an embodiment, surfaces of the driving wheel 6 and the driven wheels 7 are made of material of high friction.

The wastewater container 8 is arranged on a rear portion of the housing 5. The cleaning agent mopping device 1, the cleaning agent absorbing device 2, the water wiping and washing device 3, and the water absorbing device 4 respectively include a guiding slot or a guiding pipe to guide wastewater to the wastewater container 8.

The power supply 9 is arranged on a top portion of the housing 5 for supplying power to the cleaning agent mopping device 1, the cleaning agent absorbing device 2, the water absorbing device 3, and the water absorbing device 4.

In some embodiments, referring to FIG. 2, the cleaning robot further includes a controller 10 arranged at a position inside the housing 5 adjacent to the top portion of the housing 5. The controller 10 receives signals from a housing contacting sensor, a water level sensor, a wastewater level sensor, a humidity sensor, a step detection sensor and processes these received signals. Generally, the housing contacting sensor is arranged on an outer surface of the housing 5, the water level sensor is arranged inside the water container 32, the wastewater level sensor is arranged inside the wastewater container 8, the humidity sensor is arranged on an outer edge of the housing 5, and the step detection sensor is arranged in the foremost end of the housing 5.

In some embodiments, the first crawler device 11, the second crawler device 21, the third crawler device 31, the fourth crawler device 41, and the moving wheel group are respectively provided with elastic fastening devices. With the elastic fastening devices, no matter whether the cleaning robot works in high temperature or low temperature and no matter whether the floor is dry or wet, the total friction between the moving wheel group and the to-be-cleaned surface is greater than the total of a first friction between the first crawler device 11 and the to-be-cleaned surface, a second friction between the second crawler device 21 and the to-be-cleaned surface, a third friction between the third crawler device 31 and the to-be-cleaned surface, and a fourth friction between the fourth crawler device 41 and the to-be-cleaned surface.

The disclosure described above of the present invention is illustrative but not restrictive scope of the present invention. Any equivalent structure, or equivalent process transformation, or directly or indirectly usage in other related technical field, all those be made in the same way are included within the protection scope of the present invention.

What is claimed is:

1. A cleaning robot, comprising a cleaning agent mopping device (1), a cleaning agent absorbing device (2), a water wiping and washing device (3), and a water absorbing device (4) arranged in tum along a moving direction of the cleaning robot;

the cleaning agent mopping device (1) comprising a first crawler device (11) for contacting a to-be-cleaned surface and a cleaning agent container (12), and the first crawler device (11) applying cleaning agent from the cleaning agent container (12) to the to-be-cleaned surface and reclaiming wastewater;

the cleaning agent absorbing device (2) comprising a second crawler device (21) for absorbing remained cleaning agent on the to-be-cleaned surface and reclaiming wastewater;

the water wiping and washing device (3) comprising a third crawler device (31) for contacting the to-be-cleaned surface and a water container (32), and the third crawler device (31) applying water from the water container (32) to the to-be-cleaned surface and reclaiming wastewater; and the water absorbing device (4) comprising a fourth crawler device (41) for contacting the to-be-cleaned surface; and the fourth crawler device (41) absorbing remained water on the to-be-cleaned surface and reclaiming wastewater.

2. The cleaning robot as claimed in claim 1, wherein the first crawler device (11) comprises three first supporting shafts (111), a first crawler (112), and a couple of first clamping shafts (113);

the first crawler (112) surrounds the first supporting shafts (111), the first clamping shafts (113) tightly clamp the first crawler (112); and the first clamping shafts (113) rotated in opposite directions, and a friction between the first clamping shafts (113) and the first crawler (112) drives the first crawler (112) to rotate and squeezes wastewater out of a surface of the first crawler.

3. The cleaning robot as claimed in claim 2, wherein the first crawler (112) surrounds the first supporting shafts (111) to form an inverted triangular structure; and one of the supporting shafts (111) located at a bottom of the inverted triangular structure presses the first crawler (112) to the to-be-cleaned surface, enabling the first crawler (112) to contact and rub the to-be-cleaned surface.

4. The cleaning robot as claimed in claim 1, wherein the second crawler device (21) comprises three second supporting shafts (211), a second crawler (212), and a couple of second clamping shafts (213);

the second crawler surrounds the second supporting shafts (211), the second clamping shafts (213) tightly clamp the second crawler (212), and the second driving motor is transmissively connected to the second clamping shafts (213); and the second clamping shafts (213) rotated in opposite directions, and a friction between the second clamping shafts (213) and the second crawler drives the second crawler (212) to rotate and squeezes wastewater out of a surface of the second crawler (212).

5. The cleaning robot as claimed in claim 4, wherein the second crawler (212) surrounds the second supporting shafts (211) to form an inverted triangular structure; and two of the supporting shafts (211) located at a bottom of the inverted triangular structure presses the second crawler (212) to the to-be-cleaned surface, enabling the second crawler (212) to contact and rub the to-be-cleaned surface.

6. The cleaning robot as claimed in claim 1, wherein the third crawler device (31) comprises three third supporting shafts (311), a third crawler (312), and a couple of third clamping shafts (313);

the third crawler surrounds the third supporting shafts (311), the third clamping shafts (313) tightly clamp the third crawler (312), and the third driving motor is transmissively connected to the third clamping shafts (313); and the third clamping shafts (313) rotated in opposite directions, and a friction between the third clamping shafts (313) and the third crawler (312) drives the third crawler (312) to rotate and squeezes wastewater out of a surface of the third crawler (312).

7. The cleaning robot as claimed in claim 6, wherein the third crawler (312) surrounds the third supporting shafts (311) to form an inverted triangular structure; and three of the supporting shafts (311) located at a bottom of the inverted triangular structure presses the third crawler (312) to the to-be-cleaned surface, enabling the third crawler (312) to contact and rub the to-be-cleaned surface.

8. The cleaning robot as claimed in claim 1, wherein the fourth crawler device (41) comprises three fourth supporting shafts (411), a fourth crawler (412), and a couple of fourth clamping shafts (413);

the fourth crawler surrounds the fourth supporting shafts (411), the fourth clamping shafts (413) tightly clamp the fourth crawler (412), and the fourth driving motor is transmissively connected to the fourth clamping shafts (413); and the fourth clamping shafts (413) rotated in opposite directions, and a friction between the fourth clamping shafts (413) and the fourth crawler (412) drives the fourth crawler (412) to rotate and squeezes wastewater out of the fourth crawler (412).

9. The cleaning robot as claimed in claim 8, wherein the fourth crawler (412) surrounds the fourth supporting shafts (411) to form an inverted triangular structure; and two of the supporting shafts (411) located at a bottom of the inverted triangular structure presses the fourth crawler (412) to the to-be-cleaned surface, enabling the fourth crawler (412) to contact and rub the to-be-cleaned surface.

10. The cleaning robot as claimed in claim 1, wherein the cleaning robot further comprises a housing (5), a moving wheel group, a wastewater container (8), and a power supply (9);

the cleaning agent mopping device (1), the cleaning agent absorbing device (2), the water wiping and washing device (3), and the water absorbing device (4) are arranged at a middle positon on a bottom portion of the housing (5);

the moving wheel group comprises a driving wheel (6) arranged on a foremost end of the bottom portion of the housing (5) and two driven wheels (7) arranged at two sides on the bottom portion of the housing (5), and the driven wheels (7) are located behind the driving wheel (6) along the moving direction of the cleaning robot;

the wastewater container (8) is arranged on a rear portion of the housing (5), and the cleaning agent mopping device (1), the cleaning agent absorbing device (2), the water wiping and washing device (3), and the water absorbing device (4) respectively comprise a guiding slot or a guiding pipe to guide wastewater to the wastewater container (8); and the power supply (9) is arranged on a top portion of the housing (5) for supplying power to the cleaning agent mopping device (1), the cleaning agent absorbing device (2), the water absorbing device (3), and the water absorbing device (4).

* * * * *